US005082176A

United States Patent [19]

Preato

[11] Patent Number: 5,082,176

[45] Date of Patent: Jan. 21, 1992

[54] BASEBOARD CONDUCTOR HUMIDIFIER

[76] Inventor: Victor Preato, 98 Elmira Ave., Torrington, Conn. 06790

[21] Appl. No.: 644,312

[22] Filed: Jan. 22, 1991

[51] Int. Cl.[5] ..... F24F 3/14

[52] U.S. Cl. ..... 237/78 A; 392/352; 165/67

[58] Field of Search ..... 237/78 R, 78 A; 126/113; 392/347, 352, 386, 403; 165/67, 68

[56] References Cited

U.S. PATENT DOCUMENTS

| | | | |
|---|---|---|---|
| 2,585,764 | 2/1952 | Getz | 237/78 |
| 3,127,106 | 3/1964 | Giroud | 237/78 |
| 3,474,598 | 10/1969 | Keuls | 237/78 |

FOREIGN PATENT DOCUMENTS

| | | | |
|---|---|---|---|
| 1338841 | 10/1962 | France | 237/78 |

*Primary Examiner*—Henry A. Bennet
*Attorney, Agent, or Firm*—Dallett Hoopes

[57] ABSTRACT

A conventional baseboard radiator has a flat cover, an open metal box about the same width as the cover is supported on the cover in heat-conducting fashion. Support clips hook over the rear panel of the box and extend between the baseboard radiator and the wall to hold the box in position. A coarse screen is stretched across the top of the box and over the top of the ends. Tabs are struck out from the end panels of the box and are received by openings in the mesh to hold the screen in place.

3 Claims, 1 Drawing Sheet

BASEBOARD CONDUCTOR HUMIDIFIER

BACKGROUND OF THE INVENTION

1. Field of the Invention

This invention relates to baseboard humidifiers. More specifically, this invention relates to a humidifier attachment combined with a conventional hot water baseboard heater. Still more specifically, the invention relates to a structure secured on the cover of a conventional baseboard heater and adapted to be heated by conduction from the cover to cause the vaporization into the air of water placed in the structure.

2. Description of Related Art including Information Disclosed under §§1.97 to 1.99

There are in the prior art a number of patents relating to devices which will vaporize water from a reservoir into the air to humidify the air. In the most frequent cases, these are used in the stream of forced air heating systems. Examples are disclosed in the U.S. Pat. No. 2,585,764 which issued Feb. 12, 1952 to D. L. Getz, and U.S. Pat. No. 3,474,598 which issued Oct. 28, 1969 to H. P. C. Keuls. The latter patent discloses a housing adapted to be placed on the hot air register of a forced air heating system to permit the forced air to move up past a water-containing reservoir with wicks within the housing and out the top of the housing.

Other humidifiers in the prior art are adapted for use with hot water heating systems. An example is shown in the U.S. Pat. No. 3,127,106 which issued Mar. 31, 1964 to H. P. Giroud. In this patent depending open-top containers for water are hung down between the sections of an ordinary hot water radiator. The water is heated by the radiator and water vapor passes out the top thereof through a protective screen to humidify the room.

SUMMARY OF THE INVENTION

Under the present invention there is provided in combination with the conventional baseboard radiator having a flat cover or shelf, an open metal box about the same width as the cover and supported on the cover in heat-conducting fashion. Support clips hook over the rear panel of the box and extending between the baseboard radiator and the wall to hold the box in position. A coarse screen is stretched across the top of the box. Tabs are struck out from the end panels of the box and are received by openings in the mesh to hold the screen in place.

BRIEF DESCRIPTION OF THE DRAWINGS

Further objects and features of the invention will be apparent in the following specification and the drawings, all of which disclose a non-limiting embodiment of the invention. In the drawings.

DESCRIPTION OF THE PREFERRED EMBODIMENTS

Figure 1:
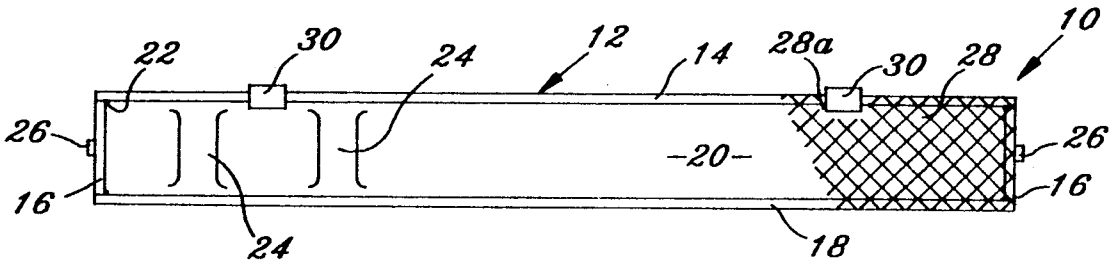
FIG. 1 is a top view of the installed box, a portion of the screen being broken away to show the bottom of the box.
Figure 2:
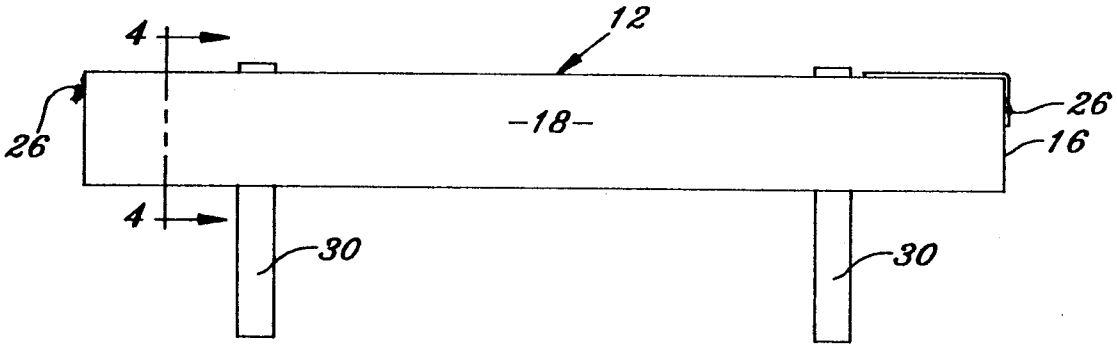
FIG. 2 is a plan view of the box and support means showing the screen only partially and showing the depending support clips.

A humidifier embodying the invention is generally designated 10 in FIG. 1. It comprises a metal open-top box 12 having a rear panel 14, end panels 16, front panel 18 and bottom 20. The box may be cut from a blank and folded and has margins of the panels soldered as at 22. If desired, or necessary, the bottom 20 may be formed with upward rectangular indentations 24 formed thereon as a place to trap warm air and further heat the container, giving more surface area to the bottom 20 for the liquid inside the box to engage and be heated by.

The end panels 16 are formed with central outwardly struck downwardly inclined tabs 26 near the top of the end panels. A coarse mesh screen 28 of plastic, for instance, may be stretched across the open top of the box and folded over the top edge of the end panels 16 so that openings in the screen 28 may be impaled to the tabs 26 respectively to hold the screen 28 in taut condition.

Figure 4:
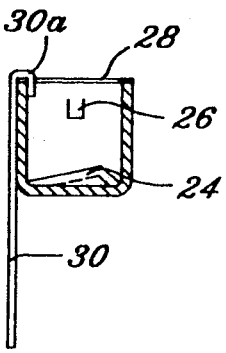
FIG. 4 is a sectional view taken on the line 4—4 of FIG. 2.

A pair of spaced retaining clips 30 are provided and may be made of thin metal. The clips are each doubled back at their upper end to form a kind of inverted "J"-shape (FIG. 4) and to provide a downward short leg 30*a* which grips the rear panel 14 between the legs of the clip. The screen 28 may be notched out as at 28*a* to receive the upper ends of the clips 30.

Figure 3:
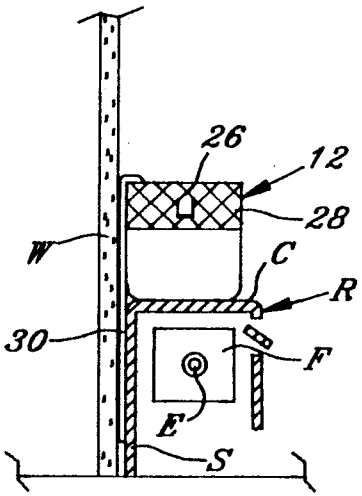
FIG. 3 is a sectional view of the humidifier including the wall, the baseboard heater and the supported box resting on the cover or shelf at the top of the heater.

As shown in FIG. 3, the humidifier comprises in combination with the structure thus far described an ordinary baseboard radiator R having a flat backing sheets and a horizontal cover or shelf C on which the box 12 sits. The longer leg of each of the clips 30 extends sown the crack between the radiator R and the wall W, with the opening in the J-shape at its upper end hooked over and thereby stabilizing the box 12 against horizontal movement. Each clip engages both sides of the rear panel as shown.

In use, as described, the box 14 sits on the cover C of the radiator R with the retaining clips 30 hooked over the top of the rear panel and extend down in the crack between the wall W and the radiator R. The box is then filled with water by pouring from a container through the screen 28. The heating element E of the radiator R is then activated, usually by circulation of hot water. This heats the fins F and by convection heats the metal cover C. In turn, the metal of the box 14 is heated largely by conduction and water within the box is elevated in temperature so that vapor will rise off its surface, adding moisture to the air. Because the width of the box 12 is approximately the same as that of the cover C, the nature of the device is both unhazardous and inconspicuous. The screen 28 thwarts any attempts that pets may have of drinking the liquid, and falling objects are deflected away from the water.

It should be understood that a number of the boxes as described may be used along the length of a baseboard radiator unit, humidifying the air to the desired extent. The clips 30 will effectively retain each box 12 against lateral movement.

While the invention has been shown in one form, variations and modifications are possible with respect to aspects of the invention. As a result, it can be seen that the invention is not limited to the embodiment shown and described but is susceptible of changes. The invention may thus be of a scope defined by the following claim language and should enjoy protection with respect to the literal reading of the claims and also the expansion of the right to exclude others from making, using or selling as is permissible under the doctrine of equivalents.

What is claimed is:

1. A room humidifier comprising in combination a baseboard radiator including a flat backing sheet of metal secured against a wall of the room at baseboard level and having a perpendicular cover extending out horizontally along the upper end thereof, the radiator including a finned tubular hot water conduit, and a rectangular metal open-topped water-tight humidifying box having substantially the same width as the cover and a rear panel end panels and a bottom, the box sitting on its bottom on the cover, a pair of spaced clips of thin sheet metal having their upper ends doubled back and hooked over the top of the rear panel of the box and engaging the opposite faces of the rear panel of the box respectively, the lower ends of the clips extending downward between the backing sheet and the wall of the room to hold the box in position on the cover proximate the wall, the box being adapted to receive liquid which is vaporized to humidify the room as the radiator heats.

2. A room humidifier as claimed in claim 1 wherein the water-tight box has tabs struck outward and downward near the top of the end panels of the box respectively and a coarse mesh protective screen extends across the open top of the box and folds over the top of the opposite end panels, the tabs receiving respective meshes of the screen to hold the screen in place.

3. A room humidifier as claim in claim 1 wherein the bottom of the box has spaced along it upward indentations to receive heated air from the radiator.

* * * * *